US006752746B1

(12) United States Patent
Winkler et al.

(10) Patent No.: US 6,752,746 B1
(45) Date of Patent: Jun. 22, 2004

(54) ADJUSTABLE JUMP ROPE APPARATUS WITH ADJUSTABLE WEIGHT AND LENGTH

(75) Inventors: Martin Winkler, Burbank, CA (US); David Schockett, Los Angeles, CA (US); Dennis Wasserman, Thousand Oaks, CA (US)

(73) Assignee: Ropesport, LLC, Burbank, CA (US)

( * ) Notice: Subject to any disclaimer, the term of this patent is extended or adjusted under 35 U.S.C. 154(b) by 0 days.

(21) Appl. No.: 10/226,603

(22) Filed: Aug. 23, 2002

(51) Int. Cl.[7] ..... A63B 21/00
(52) U.S. Cl. ..... 482/82; 482/81; 482/126
(58) Field of Search ..... 482/81–82, 126, 482/904, 907, 121, 3, 7

(56) References Cited

U.S. PATENT DOCUMENTS 2,723,121 A * 11/1955 Cartwright et al.
4,079,932 A 3/1978 Schuetz
4,157,827 A 6/1979 Winston et al.
4,293,125 A 10/1981 Hinds
4,637,606 A 1/1987 Hunn
4,647,037 A 3/1987 Donohue
4,778,173 A 10/1988 Joutras
4,787,624 A 11/1988 Grant
4,801,137 A * 1/1989 Douglas
5,054,772 A 10/1991 Winston
5,478,297 A 12/1995 Dennis
6,544,149 B2 * 4/2003 O'Shea

* cited by examiner

*Primary Examiner*—Jerome W. Donnelly
(74) *Attorney, Agent, or Firm*—Reed Smith, LLP

(57) ABSTRACT

An adjustable jump rope apparatus allows easy and quick adjustment of the jump rope length by inserting and threading the jump rope through grooves around a ball-shaped bearing member, and then attaching the end of the jump rope to the body of the jump rope with a clip. The ball-shaped bearing member is rotatably retained within a hollow handgrip. Undoing the clamp and sliding the rope in either direction allows for a quick and easy jump rope length adjustment. A removable support structure enables the addition/removal of incremented weights to and fixes and supports the weights inside each hollow handgrip, thereby providing a weighted jump rope or even a dumbbell when a jump rope is not attached. Weight distribution is even as the weights extend substantially the entire length of the handgrip. The support structure also simultaneously assists in retaining the ball-shaped bearing member within the handgrip.

21 Claims, 4 Drawing Sheets

3A
3B
3C
15
20
24
3A
12a
12
14a
3B
3C
14
17
10

14a
32
15
4
14
20
24
12a
12
10
4

14b
12a
14a
14
12a
14
12
10

2B
2C
10
12
12a
13
14
15
16
17
20
20a
22
26
26a
27
28
29
30
31
32
33
34
36

17
20
20a
22
24
12
16

38
12
39
13
37
39
24
13a 12
38
12
42
24
50
50
13

12
13a
39
24
37
13
37

ADJUSTABLE JUMP ROPE APPARATUS WITH ADJUSTABLE WEIGHT AND LENGTH

TECHNICAL FIELD

The invention generally relates to the field of exercise or sports equipment. More specifically, it relates to a high performance jump rope apparatus whereby adjusting jump rope length, inserting a different jump rope and adding or removing weight is easily and quickly accomplished.

BACKGROUND OF THE INVENTION

Jumping rope enhances endurance, strength, quickness, coordination and balance. More and more people who enjoy exercising are jumping rope, because it allows maximum conditioning and calorie consumption in a relatively short exercise bout. The natural benefits of jumping rope have become so well known, that fitness clubs offer jump rope conditioning courses to meet the needs of a fast, fun and efficient cardiovascular workout. In fact, jumping rope has become so popular that competitive rope jumping is a sport all to its own.

Originally a rope user would use a plain unadorned rope. Such a rope was prone to becoming excessively twisted and was sometimes hard on the hands. Later simple handles were attached to the ends of the jump rope partly to alleviate these problems; however such a design and construction still led to twisting and lagging of the rope in relation to the hands during use due to the fixed connection between the rope and the handle.

Eventually, a jump rope having wooden handles and a ball bearing assembly, fit into a recess in each handle, was disclosed in U.S. Pat. No. 4,293,125 to Hinds. The ball bearing assembly was intended to uncouple the rope from the handle to avoid twisting and lagging. However, such structures were generally too expensive, and too difficult to disassemble and replace or repair. Hinds taught using cylinder shaped jump rope handles containing a hemispherical or funnel-shaped socket in which a small ball was movably retained. The rope passed through the center of the small ball, and the rope was then fixed inside the handle by a knot. This design, despite marked improvements in functionality (decreased rope twisting and lagging), had the drawback that adjustment of the jump rope length was cumbersome and time consuming because the device had to be disassembled by pulling the small ball through the rear end of each handle. This delay negatively affects athletes training for maximum aerobic capacity, especially when various length or weighted ropes are necessary to accomplish their training needs optimally. Further, such rope-adjusting difficulties and time delays also hamper jump ropes used in a gym or fitness club setting, as equipment that is too difficult or time consuming to adjust often goes unused.

U.S. Pat. No. 4,079,932 to Schuentz also discloses a length adjusting means. Rope adjustment is accomplished by inserting the jump rope tail end through an opening in the jump rope handle and looping the rope back towards the running portion of the rope, and tying the tail to the running portion. U.S. Pat. No. 4,637,606 to Hunn discloses a ring member secured to a bearing on a jump rope handle that is further connected to a hook or eye attached to a jump rope. Various length jump ropes can be attached to the handles ring members, or a jump rope can be permanently fixed at a desired length via a rope clamp. This design only works with ropes of fixed lengths thus entailing additional costs to purchase multiple ropes if different lengths are needed.

Finally, U.S. Pat. No. 5,478,297 to Dennis, Jr. teaches inserting a cord through either of two receiving holes attached to a handle, whereby the cord is then adjusted by means of a cord clamp. The excess rope resides inside one of two parallel passages in a free-spinning bearing spindle inside each of the handles. Despite a relatively simple mechanism for adjusting or changing desired ropes or rope lengths, this invention is still prone to twisting or lagging when the rope makes an obtuse angle with the long axis of the spindle.

As jump rope handles were developed to allow various rope adjustments and enhance speed and smoothness of rotation, a means for adding weight to the handles became desirable to increase the cardiovascular work out, and to strengthen user's upper body. Schuentz (U.S. Pat. No. 4,079,932) discloses a jump rope having hollow shell handles that allows water or sand to be added to create a weighted handle. Other jump rope inventions disclose attaching weights to one or both ends of each jump rope handle as in a patent to Donohue (U.S. Pat. No. 4,647,037). Another design even connected a jump rope to a set of hand weights as disclosed in a patent to Grant (U.S. Pat. No. 4,787,624). All such designs limit the users abilities to manipulate the weights in the jump rope handles, have uneven weight placement, and/or require significant time to adjust the weights. These designs generally do not allow a comfortable and natural handgrip feeling when weights are added to the jump rope handgrips.

U.S. Pat. No. 4,157,827 to Winston teaches using a hollow body member with an access opening to a storage compartment for holding exercise weights. A plug is inserted after removal or insertion of a weight to maintain the structure of the jump rope handle. This invention uses soft plastic handles, which may require the user to grip the handles tightly in order to keep the inserted weights stable.

U.S. Pat. No. 4,778,173 to Joutras also discloses a jump rope that allows inserting a weight into the end of a handle body portion; however this invention provides no support means for fixing the weight to prevent the weight from rotating or jarring inside the handle. Further, an extra hand guard and a screw down cap present the user with a somewhat complicated means of securing the weights.

U.S. Pat. No. 5,054,772 to Winston discloses a jump rope handle that allows a weight to be inserted; however, a rope length adjusting means is not simultaneously provided. Further, like the Jountras patent, no means is provided for supporting the weight to prevent the weight from rotating or jarring inside the handle.

Thus, prior art in the inventive field teaches complicated and time consuming means for adjusting jump rope handle weight or jump rope length. Further, many disclosures require the use of separate ropes or weight securing means that can allow the weights to become loose.

It is therefore desirable to produce a jump rope apparatus that allows a user to quickly and easily adjust jump rope length externally, without having to open the jump rope handgrips.

It is also desirable to produce a jump rope apparatus that allows the addition or removal of finely incremented weights that are supported within the handgrips.

It is also desirable to produce a jump rope apparatus that contains a readily removable and adjustable bearing to eliminate rope twisting.

It is further desirable to produce a jump rope apparatus whereby the jump rope can be easily changed to allow weighted or speed ropes of varying lengths to be easily attached.

It is also desirable to produce a jump rope apparatus, wherein the handles can readily be used without a rope for practice purposes or as hand weights for exercise.

SUMMARY OF THE INVENTION

The present invention satisfies the above-described need by providing a jump rope apparatus wherein each tail or end of a jump rope is: 1) inserted into a channel cut into the base of a ball-shaped bearing member; 2) passes through a groove cut into the head of the bearing member; 3) exits through a second channel to emerge from the bearing member parallel to the remaining or running portion of the rope; and 4) is attached thereto. The ball-shaped bearing member is rotatably retained within a hollow handgrip member. A support structure enables the addition and removal of weights and removably fixes and supports the weights inside each handgrip member. The support structure also removably retains the ball-shaped bearing member inside the handgrip member and tensions the bearing member against a frictionless bearing surface inside each handgrip to allow the bearing member and the attached jump rope to easily rotate in relation to the handgrip. A spring-loaded cap holds the weights and the support structure in a stable and relatively fixed position.

DETAILED DESCRIPTION OF THE INVENTION

Figures 1A, 1B, 1C:
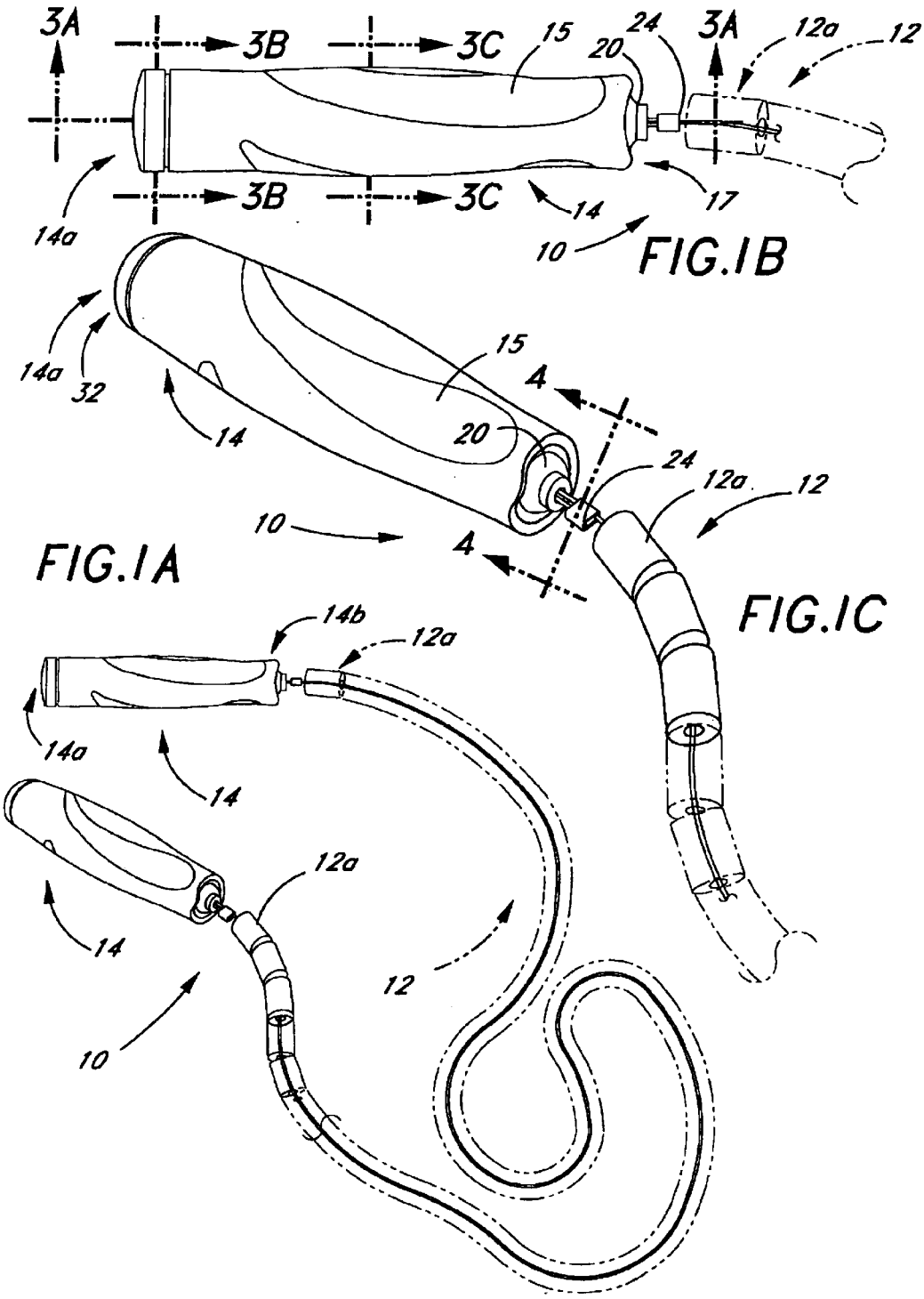
FIG. 1A is a perspective drawing of an entire jump roper of the present invention with the rope mostly shown in phantom.
FIG. 1B is a close up view of one of the handgrips of the jump rope of FIG. 1A to show the attachment of the rope to the ball-shaped bearing member.
FIG. 1C is a different view of the handgrip of FIG. 1B showing the rope exiting from the ball-shaped bearing member.
Figures 2A, 2B, 2C:
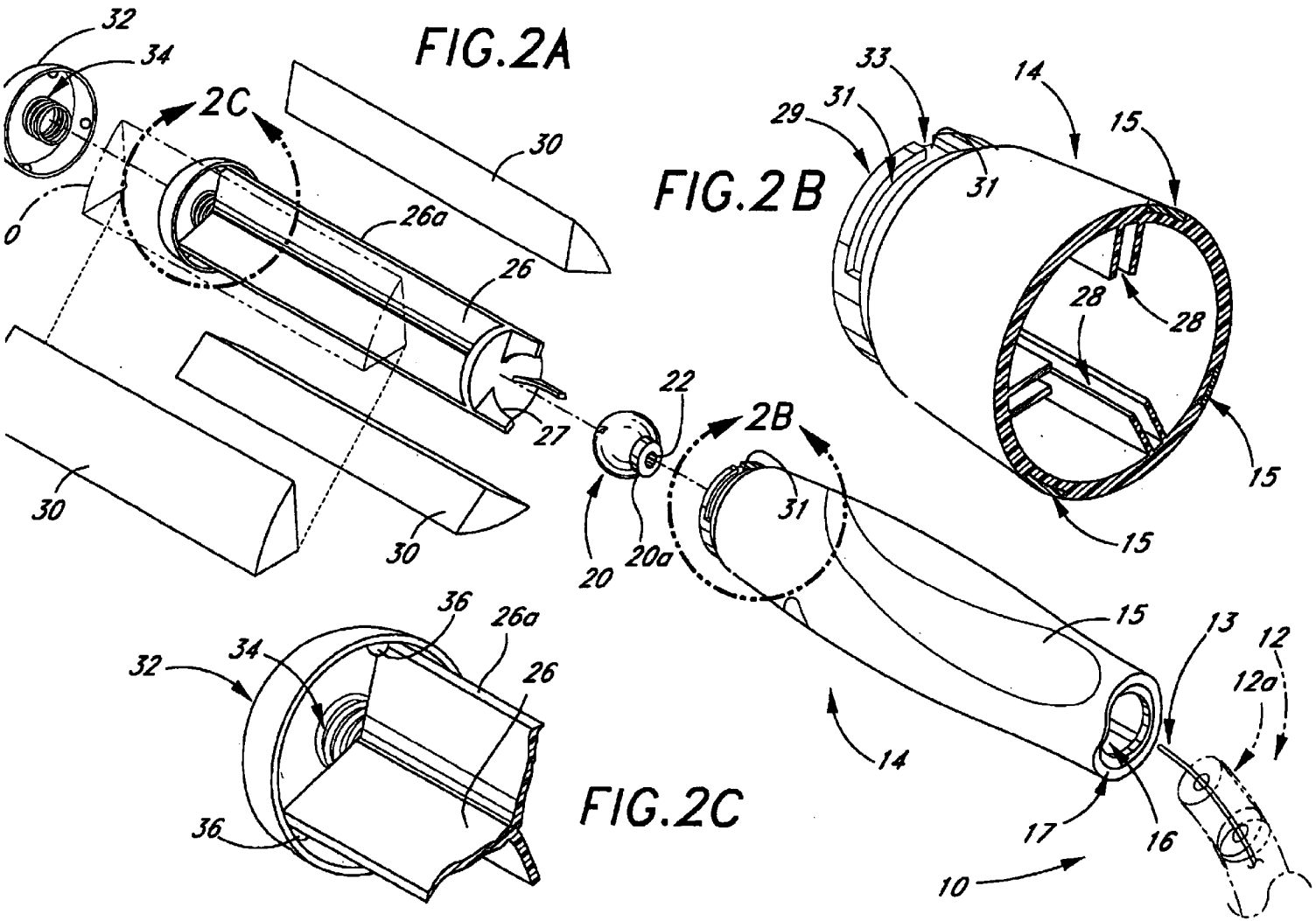
FIG. 2A is an exploded view of the handgrip and bearing member of FIG. 1B.
FIG. 2B is a close up section through the handgrip at the point indicated by "2B in FIG. 2A.
FIG. 2C is a close up section through the handgrip at the point indicated by "2C in FIG. 2A.
Figure 3A:
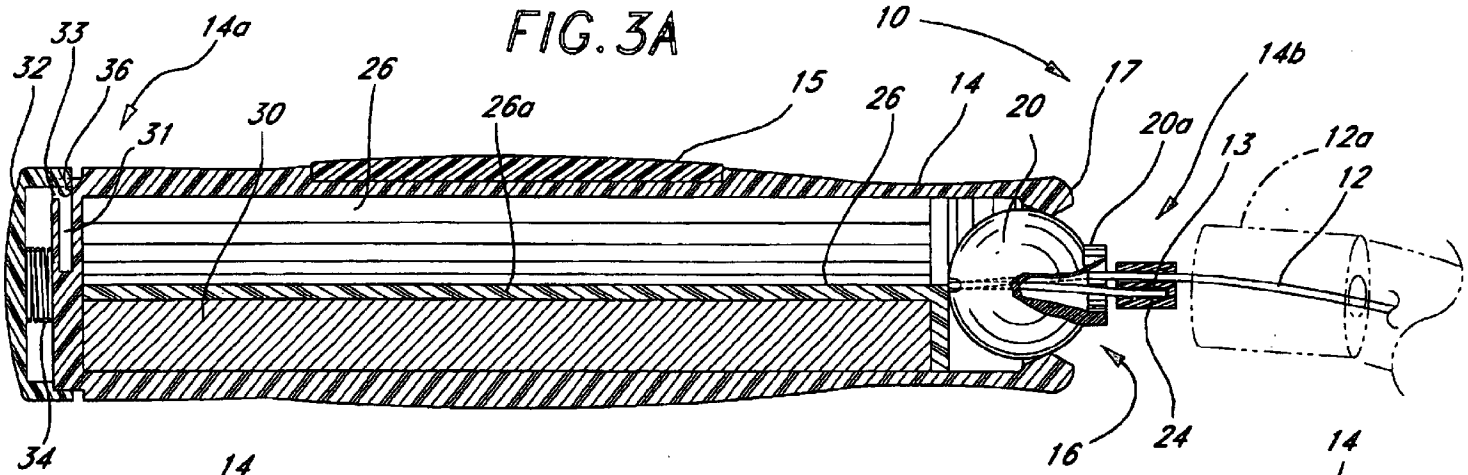
FIG. 3A is a longitudinal section of the handgrip of FIG. 1B along the plane 3A—3A.
Figure 4:
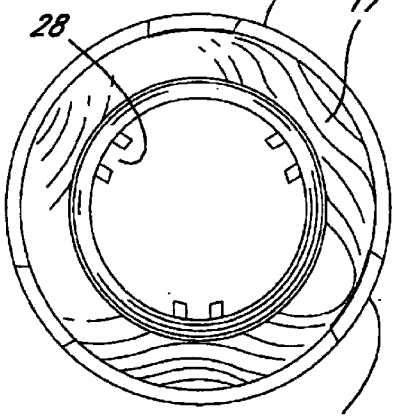
FIG. 4 is a view of the handgrip of FIG. 1C as seen from the plane 4—4.
Figure 3C:
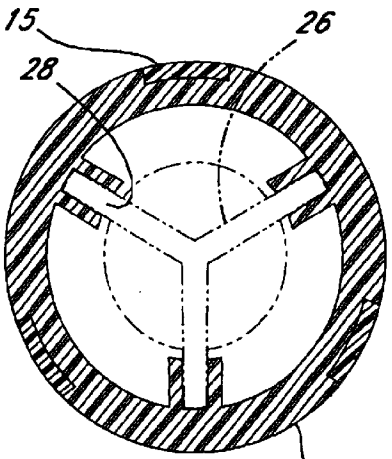
FIG. 3C is a view of the handgrip of FIG. 1B as seen from the plane 3C—3C.
Figure 3B:
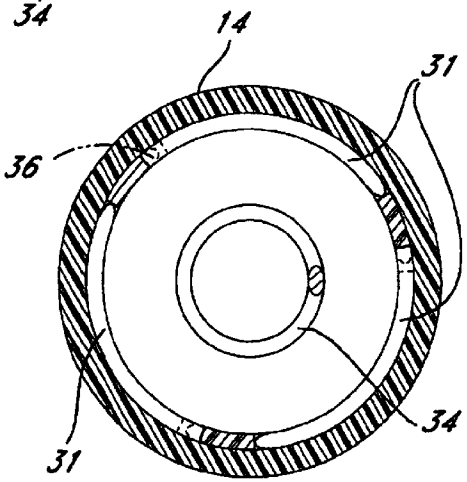
FIG. 3B is a view of the handgrip of FIG. 1B as seen from the plane 3B—3B.

The present invention relates to creating an adjustable jump rope apparatus by first inserting a jump rope tail end through a bottom end opening and then a top end opening of a handgrip, by next inserting the jump rope end into an opening in a ball-shaped bearing member, passing the jump rope tail end through an opening in the bearing member and through a groove cincturing a top end of the ball-shaped bearing member, and then back through the opening. Next a locking mechanism is used to attach the jump rope tail end that has been looped through the ball-shaped bearing member to a point along the running portion of the same jump rope to set the desired length of the rope. Then one, pulls the jump rope (now attached to the ball-shaped bearing member) back through the top end of the handgrip until the ball-shaped bearing member is resting against and articulates with a surface inwardly protruding from the bottom end of the handgrip. Finally, a removable support structure is inserted into a receiving structure located inside the handgrip, wherein the bottom end of the removable support member 26 bears a cup-shaped cage 27 for trapping the ball-shaped bearing member 20 in a low friction mode inside and against the retaining surface 17 of the handgrip opening 16. Elongate weights can be optionally inserted into the support structure, and the top end opening closed by affixing a spring-loaded cap.

EXAMPLE

To create the adjustable jump rope apparatus 10 described above, the jump rope 12 of the adjustable jump rope apparatus can be made of any low friction, aerodynamic, densely weighted, or faster spinning jump rope (known as a speed rope) material such as metal (steel), cotton, polyester or leather, however a preferred embodiment utilizes nylon because it is durable and inexpensive, and can easily support the attachment of protective beads 12*a* that increase the weight of the jump rope while providing an anti-tangling and anti-friction effect and protecting the jump rope. Further, it is also possible to attach a jump rope having heavier or lighter protective beads 12*a*, or to add or subtract various weighted protective beads 12*a* in order to increase or decrease the work required to swing the jump rope. The jump rope end or tail is inserted through an opening in a ball-shaped bearing member 20, and then fed around a groove cut in a top portion of the surface of the ball-shaped bearing member 20, and then back out parallel to the entering rope. The jump rope end can be pulled out of the same opening in the ball-shaped bearing member 20, or, in an alternate embodiment, pulled out through a separate opening located near the initial opening. The jump rope end normally bears a metal ferrule or sleeve, not unlike the aglets or tips on shoelaces that facilitate passing the laces through the eyelets. The metal ferrule or sleeve prevents the end of the jump rope from unraveling or fraying and makes it easier to thread the rope end through the ball-shaped bearing member 20 and helps retain the tail in a clamping device as explained below. It is also possible to incorporate plastic or other rigid materials, or use a coating to protect the end of the jump rope.

The handgrips 14 of the preferred invention are cylindrically shaped with a slightly larger top end circumference 14*a* and a slightly narrower bottom end circumference 14*b*. Moving from the top of a handgrip 14 towards its bottom end, the handgrip 14 bottles down into a neck before slightly expanding again at its bottom-most end 14*b*. The shape just described is not essential but makes the handgrip better fit the user's hands. The handgrips 14 can be made from any material that can support individual and fitness club use, but in preferred embodiments, the handgrips are made of polypropylene or ABS (acrylonitrile-butadiene-styrene) plastic. Other materials plastic materials and materials such as wood or metal are also functional in the present invention. In one embodiment, the handgrip is formed in a mold, which includes raised gripping structures that spiral slightly and longitudinally cover a substantial length of each handgrip 14. The raised gripping structures can be made advantageously of any soft or spongy materials such as neoprene, or they can also be formed from harder material such as polypropylene or ABS plastic. One embodiment of the gripping structures Uses Santoprene® (thermoplastic elastomer or TPE). The raised gripping devices allow the user to tactilely or visually find the handgrips' sweet spot during use. This provides the user with a secure, soft and giving grip that is very comfortable, and easy to hold, and allows the user rapidly to locate the optimal gripping position.

The ball-shaped bearing member 20 which receives the covered jump rope tail is substantially globular, however other shapes (i.e., elliptical) that allow a low friction interaction with the bearing surface are also appropriate. In one embodiment, a cylindrical portion 20*a* protrudes from the bottom surface of the ball-shaped bearing member 20 to receive the jump rope tail. The cylindrical portion 20*a* allows the user to swings the jump rope at obtuse angles in relationship to the handgrip. In such a case, the ball-shaped bearing-member 20 swivels in relation to the handgrip 14 with the cylindrical portion 20*a* essentially tracking the rope 12. The cylindrical portion 20*a* protects the jump rope 12 from rubbing against the circular flange 17 of the bottom end opening 16 of the handgrips 14. The ball-shaped bearing member 20 is made from a low friction material such as Delrin® (generically known as acetal or poly-acetal); nylon and polytetrafluoroethylene because of such materials are self-lubricating, durable and low in friction.

Once the covered jump rope tail is inserted into the ball-shaped bearing member 20, the jump rope cinctures the top surface of the ball-shaped bearing member 20 by way of a groove in one preferred embodiment. The jump rope is partially exposed at the top end of the ball-shaped bearing member 20 where the groove is visible and accessible. This assists the user in inserting and removing the jump rope end from the ball-shaped bearing member 20. It is possible, however to create a ball-shaped bearing member 20 with the rope passing: 1) through channels only in the interior of the ball-shaped bearing member 20; 2) through external groove (s) circumnavigating the outside of the ball-shaped bearing member 20; or 3) through some combination thereof. Further, in one embodiment, it is also possible to utilize a ball-shaped bearing member that includes only an eyelet or small opening through which to insert the jump rope tail. In such an embodiment, the jump rope end would not 'horseshoe' around the ball-shaped bearing member 20, as it would merely be inserted into, around, and then back out of the eyelet (being retained by a structure within the bearing member).

Once the jump rope end is threaded through, around, and back out of the ball-shaped bearing member 20, a locking member 24 is clamped to the jump rope to fix the jump rope's length and to keep the rope inserted into the bearing member 20. In one embodiment locking member 24 is a more or less rectangular structure that contains: 1) two side-by-side, but oppositely facing grooves separated by an inner wall that allow the removable placement of the covered jump rope tail and the jump rope running portion within; and 2) two hinge doors (one for each groove) that enclose the covered jump rope tail and the jump rope running portion within the two grooves. A variety of locking member 24 clips or clamps can be used in the present invention. It is preferable that the structure selected allows ready removal for adjustment of the rope but is proof against accidental removal.

Figures 5A, 5B, 5C, 5D:
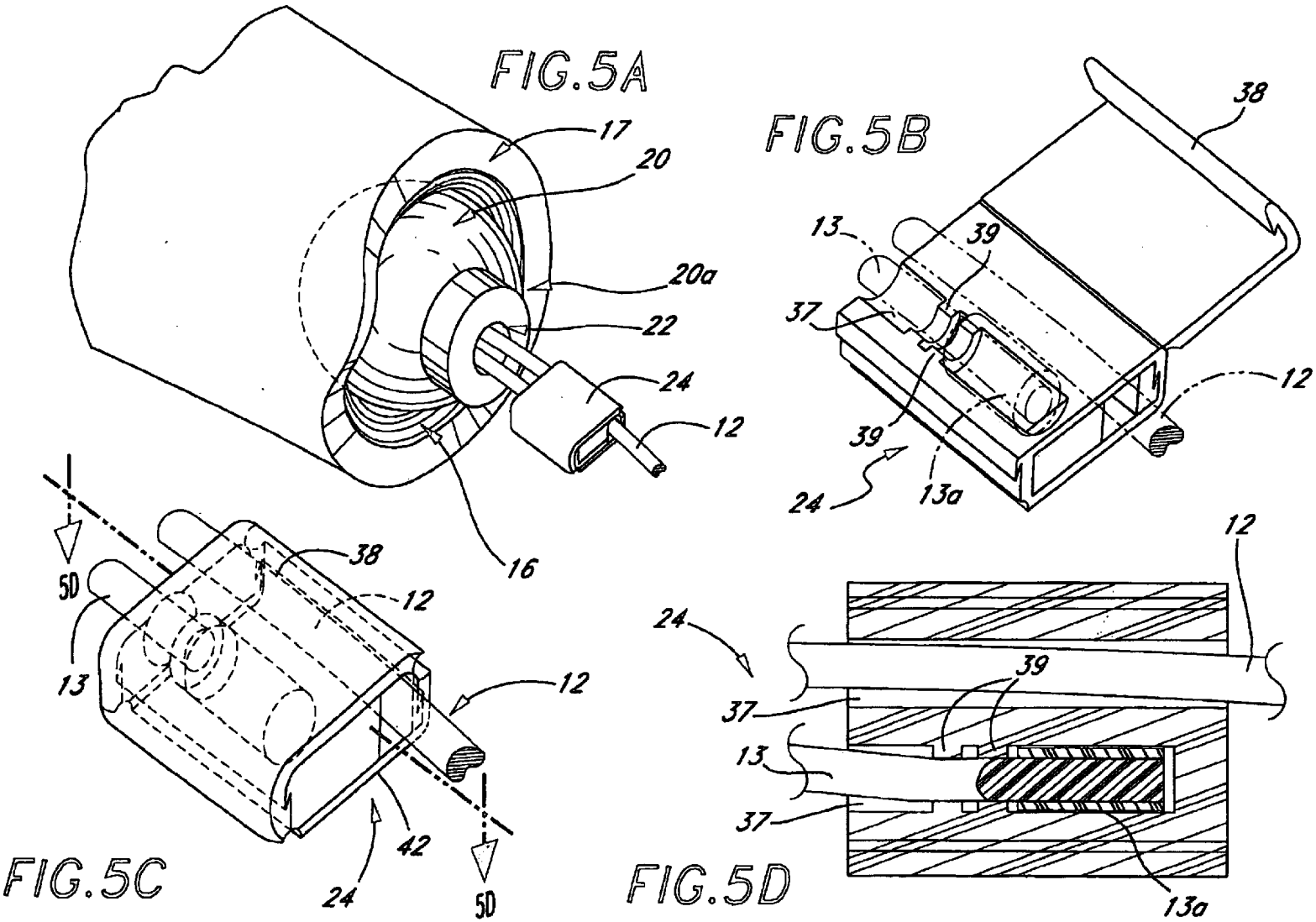
FIG. 5A is a close up view of the bottom end of the handgrip of FIG. 1.
FIG. 5B is close up of the locking member opened to show the close ended groove.
FIG. 5C is a close up of the locking member.
FIG. 5D is a longitudinal section of the locking member showing both grooves with the rope tail and running portion of the rope in position.

In FIG. 5, the locking member 24 is shown with one groove 37 that has one open end and one closed end. This groove 37 and its respective hinge door 38 allow the covered jump rope tail 13 to be retained within. The jump rope tail 13, covered by a ferrule 13*a*, rests against the groove's closed end with the ferrule 13*a* being too large to pass through a constriction 39—thus, the tail 13 is captured within the locking member 24. A groove 41 enclosed by the other hinge door 42 has two open ends, allowing the running portion of the jump rope to pass completely through the locking member 24. Once the jump rope tail 13 and the jump rope running portion are placed in their desired positions within their respective grooves, a user simple presses them down into the grooves to fix them in place, and each door is then hinged over its respective groove and snapped closed, thereby removably fixing the jump rope tail 13 and jump rope running portion.

For example, temporarily attaching the jump rope end and the jump rope to the locking member 24 is accomplished in a preferred embodiment by: unsnapping and opening the hinge door 38 covering the one closed ended groove 37 of the locking member 24; placing the jump rope tail against the closed end of that groove and then pushing the jump rope end down so that the ferrule 13*a* is retained by the constriction 39 and then closing that hinge door 38, thereby completely capturing the jump rope tail 13. The other hinge door 42 located on the opposite side of the locking member 24 is opened and the steps described above are repeated; however, this time the running portion of the jump rope (the portion of the jump rope that has not passed through the ball-shaped bearing member 20) is captured by teeth or similar structures within the groove 41, which has both its ends open, thereby allowing the jump rope to enter and exit the locking member 24. This simplifies removing the jump rope to use the handgrips separately, changing the jump rope, or adjusting the length of the jump rope. Ease of changing ropes makes it simple to remove the rope and practice with the handles alone.

Jump rope length adjustment is especially easy, as a user does not have to disassemble the handgrip. The user simply: 1) unhinges the door 42 capturing the running portion; 2) move the locking member 24, with the covered jump rope tail 13 captured within, along the running portion of the rope until the desired jump rope length is achieved; and then 3) (if there are beads on the rope, first separate the beads at the desired location) closes the hinge door 42 to reattach the locking member 24 to the running portion. Obviously, the running portion of the rope is fed through the bearing member 20 so that the length of the rope on the tail end is increased or decreased as desired. The locking member 24 can be made of any material that will sufficiently and durably immobilize the jump rope, however a plastic such as polypropylene that exhibits the "living hinge" property is preferred.

It is possible to use other locking member designs including locking devices of various configurations such as a two-sided locking member having both side-by-side grooves with two open ends. Such a design allows the jump rope end to dangle outside the locking member. In another embodiment, it is also possible to make a locking member 24 that has one hinge door covering two grooves.

In a one embodiment, the jump rope tail and the jump rope running portion, now fixed to the ball-shaped bearing member and the locking member 24, are pulled back through the top end 14*a* of the handgrip 14 until the ball-shaped bearing member 20 is caught and retained by an inward facing chamfered surface 17 that protrudes from the bottom end 14*b* of the handgrip 14. In another embodiment, however it is possible to snap the ball-shaped bearing member 20 into an inward facing socket, thereby eliminating the need to insert the jump rope end completely through the handgrip 14 to attach it to the ball-shape bearing member 20. This can facilitate an even quicker and easier means of changing jump ropes. In either embodiment, the chamfered surface provides a bearing surface that allows a low friction interaction with the ball-shaped bearing member 20. The inward facing chamfered surface can be made of any material that will sufficiently retain the ball-shaped bearing member 20 while maintaining a low friction interaction. However, like the handgrip, a polypropylene or ABS plastic is used when making a preferred embodiment due to its durability and relatively inexpensive production costs. As will be apparent to one of skill in the art, a low friction interaction can best be attained by maintaining a sufficient difference in hardness between the ball-shaped bearing member 20 and the retaining flange 17. Further, in a one embodiment, the inward facing chamfered surface or flange 17 is integral with the handgrip 14 and is formed by the same mold. However, it is also possible to create the handgrip 14 by attaching a separately formed flange 17. In another embodiment, the flange 17 does not have to be continuous. The flange can be comprised of a plurality of separate flanges, attached or formed at spaced apart points within the inner surface of the handgrip bottom opening 16.

To prevent the ball-shaped bearing member 20 from sliding towards the top of the handgrip 14, and to assist in holding the ball-shaped bearing member 20 in a low friction interaction with the inward facing chamfered surface or flange 17, a removable support structure 26 is inserted through the opening in the top end 14*a* of the handgrip 14. In the illustrated embodiment, the support structure 26 is "skeleton-like. By skeleton-like is meant that the support structure is a largely open framework (as is a skeleton). The openings in the framework accommodate removably inserted weights. To prevent the support structure 26 from moving about as the jump rope is used, portions 26*a* of the support structure 26 slides into a plurality (here three) of grooves or guide ways 28 on the interior surface of the handgrip 14. In one embodiment, the guide ways are represented by a series of ridges forming grooves along the inside surface of the handgrip. The ridges run a substantial length of the inside of each handgrip, and each portion 26*a* of the removable skeleton like support structure 26 is inserted into each one of the grooves 28 formed by the ridges. One of skill in the art can readily envision a variety of other structures used to guide and position the support structure 26. The bottom end of the support structure 26 bears a cup-shaped cage 27 for retaining the bearing member 20.

The removable support structure 26 in the illustrated embodiment is trimerous, with three vanes or portions 26*a* radiating from a central point. However, any number of equal or non-equal sections can be used. The removable support structure houses the addition of removable elongate weights 30 (here wedge-shaped). The removable support structure can also be made of a polypropylene or ABS plastic, but any material that is strong and durable enough to support weights 30 within the handgrip 14 can be used.

Further, in the illustrated embodiment, each removable elongate weight 30 resembles a one-third piece of a pie from a top or bottom view, and an elongated rectangle from a side view; however, each weight can comprise any elongated shape that corresponds to the individual sections of the removable support structure 26 into which the weights 30 are to be inserted. An advantage of multiple sections within the skeleton-like support structure 26 is that one can gradually add or subtract weights from the support structure 26 to allow a range of users to achieve an optimal handgrip weight. The removable rod-shaped weights 30 can be made using any material that achieves a desired individual or cumulative weight. One embodiment incorporates weights made of zinc plated steel. Because the elongate weights run substantially the entire length of the handgrip 14, the distribution of the weight is exceptionally even—thus facilitating ease of use. The variable weight features and ease of rope removal allow the handgrips to be used as exercise hand weights only.

The removable support structure 26 also includes a cup-shaped bottom end 27. In the illustrated embodiment, the cup-shaped bottom end 27 is an extension of each of vanes 26*a* of the support structure 26, wherein each vane's bottom-most end has a concave shape so that the ball-shaped bearing member 20 can be cradled within the cage 27. The cup-shaped cage 27 also comprises a partition that separates the removable rod-shaped weights 30 from the ball-shaped bearing member 26 so that the weights 30 do not press against the bearing member 20. The partition resembles a disk horizontally placed between the weight supporting area and the cup-shaped cage 27 of the removable support structure 26. The partition may be made using any other shape, or piece or pieces that function to stabilize and separate the removable elongate weights 30 from the ball-shaped bearing member 26.

The top-most end 14*a* of the handgrip 14 has a slightly indented or smaller circumference portion, which allows a cap 32 to be attached. The interaction of the top-most end 14*a* of the handgrip 14 and the cap 32 is a bayonet mount. The cap 32 includes a centrally located spring 34 that pushes against the central portion of the top end of the support structure 26 if no weights 30 are installed. Since the weights 30 are slightly longer than the portion of the support structure 26 into which they can be inserted, if weights 30 are inserted, the spring 34 will press on the weights 30 instead of the support structure 26. If the cap 32 is pressed towards the handgrip 32, the spring 34 will be depressed allowing the cap 32 to slide over the slightly indented or smaller circumference portion of the top-most end of the handgrip 14. Twisting the closure cap clockwise engages teeth 36, located on the inner ring surface of the closure cap, into grooves 31 located on the exterior surface of the top-most end of the handgrip 14. The tooth and groove interaction secures the closure cap 32 against the handgrip, eventually allowing the closure cap 32 to raise slightly when the teeth 36 reaches a detent locking point at the end of the grooves. To undo the bayonet mount, a user simply pushes cap 32 against the handgrip 14 and twists the cap counter-clockwise until the teeth 36 become disengaged from the grooves and the spring releases the cap 32.

In FIG. 1, an adjustable jump rope apparatus 10 incorporating the invention comprises a jump rope 12, optionally including protective jump rope beads 12*a*. The jump rope 12 also contains a covered jump rope tail 13 that is inserted completely through the bottom end handgrip opening 16 and the top end handgrip opening 18 of a handgrip 14. A raised gripping structure 15 enables a user to visibly or physically grip the handgrip's sweet spot with ease ensuring optimum orientation of the handgrip 14.

After the covered jump rope tail 13 is passed completely through the bottom end handgrip opening 16 and the top end handgrip opening 18 of the handgrip 14, the covered jump rope tail 13 is then inserted into an opening 22 located in a cylinder 20*a* protruding from the ball-shaped bearing member 20. The covered jump rope tail 13 is further threaded through arcuate or U-shaped groove cincturing the ball-shaped bearing member 20 until the covered jump rope tail 13 exits the opening 22 in the ball-shaped bearing member 20. Once the covered jump rope tail 13 exits the opening 22 in the ball-shaped bearing member 20, it may be removably fastened to any point on the running portion of the jump rope 12 via a locking member 24. The locking member 24 captures the jump rope 12 and the covered jump rope tail 13, and prevents the covered jump rope tail 13 from sliding out of or exiting the ball-shaped bearing member 20. The ball-shaped bearing member 20 is now pulled back through the top end circular edge handgrip opening 18 until the ball-shaped bearing member 20 is caught by and rests in a low friction relationship against an inward facing chamfered surface or flange 17 protruding from the bottom end handgrip opening 16. The inward facing chamfered surface 17 forms a low friction articulation with the ball-shaped bearing member 20.

The removable support structure 26 is then inserted into the handgrip 14 with protruding portions 26*a* of the support member 26 sliding into receiving structures 28 that run substantially the length of the inside of the handgrip 14. The removable support structure 26 supports and surrounds elongate weights 30 that are used to increase a user's upper body strength and/or increase workout intensity. The removable support structure 26 comprises a cup-shaped bottom end 27 and a top end 29. The cup-shaped bottom end 27 assists in retaining the ball-shaped bearing member 20 in a low friction relationship with the inward facing chamfered surface 17. With the locking member 24 exposed and located outside the handgrip 14, it is also possible quickly and easily to adjust the length of jump rope 12 without opening the handgrip 14.

The top end of the handgrip 14 is closed with a cap 32. This is accomplished through the interaction of recessed grooves 31 and entry grooves 33 located around the external top of the handgrip 14, with teeth 36 located on the inner ring surface of the closure cap 32 and a spring 34 centrally located on the interior surface of the closure cap 32. The teeth 36 engage the recessed grooves 31 when the closure cap 32 is twisted onto the top end of the handgrip 14. The spring 34 assists in locking the teeth 36 into the detents in the recessed groove. In addition, the spring presses against the support structure 26 or the weights 30 biasing the support structure 26 towards the ball-shaped bearing member 20 at the opposite end of the handgrip 14.

The following claims are thus to be understood to include what is specifically illustrated and described above, what is conceptually equivalent, what can be obviously substituted and what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. An adjustable jump rope apparatus comprising:

a rope having an end;

a bearing member having a channel with the rope end threaded a ball-shaped bearing member having a channel with the rope end threaded therethrough and doubled in a side by side relationship with the rope;

a handgrip top end with an opening diameter larger than a diameter of the bearing member; and a handgrip bottom end with an opening diameter smaller than the diameter of the bearing member, said opening retaining the bearing member within the handgrip with the bearing member rotationally in contact with an edge of the opening;

a support structure sized to be inserted through the top end opening of the handgrip so that when inserted fully into the handgrip the support member prevents the bearing member from moving to the top end of the handgrip; and means for retaining the support member within the handgrip.

2. The adjustable jump rope apparatus according to claim 1, wherein the handgrip bottom end opening bears a flange that creates a low friction interaction with the bearing member.

3. The adjustable jump rope apparatus according to claim 1, wherein the rope is doubled back so that the rope end is in a side by side position in relation to the rope.

4. The adjustable jump rope apparatus according to claim 1, wherein the rope is selected from the group consisting of metal, cotton, polyester, nylon or leather.

5. The adjustable jump rope apparatus according to claim 1 further comprising beads on the rope.

6. The adjustable jump rope apparatus according to claim 1, wherein the rope end has a covering.

7. The adjustable jump rope apparatus according to claim 6, wherein the covering is a metal ferrule.

8. The adjustable jump rope apparatus according to claim 1, wherein the handgrip includes a raised gripping region.

9. The adjustable jump rope apparatus according to claim 8, wherein the raised gripping device is made of a thermoplastic elastomer.

10. The adjustable jump rope apparatus according to claim 1, wherein the bearing member is ball shaped.

11. The adjustable jump rope apparatus according to claim 1, wherein the support structure interacts with guide ways on an interior surface of the handgrip.

12. The adjustable jump rope apparatus according to claim 1, wherein the support structure is formed into compartments into which weights can be inserted.

13. The adjustable jump rope apparatus according to claim 12, wherein the weights are wedge shaped in cross section.

14. The adjustable jump rope apparatus according to claim 1, wherein the means for retaining the support structure comprises a cap for closing the handgrip top end opening.

15. The adjustable jump rope apparatus according to claim 14, wherein the cap further contains a spring for biasing the support structure towards the bearing member.

16. The adjustable jump rope apparatus according to claim 1, wherein the support structure comprises a cup-shaped bottom end for retaining the bearing member.

17. The adjustable jump rope apparatus according to claim 1, wherein the means for retaining the rope end comprises a clip fastened onto the rope.

18. The adjustable jump rope apparatus according to claim 1, wherein the bearing member is made from a low friction plastic material.

19. The adjustable jump rope apparatus according to claim 18, wherein the low friction plastic material is selected from the group consisting of poly-acetal, nylon and polytetrafluoroethylene.

20. An adjustable jump rope apparatus comprising:

a rope having an end;

a ball-shaped bearing member having a channel with the rope end threaded therethrough and doubled back in a side by side relationship with the rope;

a hollow handgrip comprising:

a handgrip top end with an opening diameter larger than a diameter of the ball-shaped bearing member; and a handgrip bottom end with an opening diameter smaller than the diameter of the ball-shaped bearing member, a lip of said opening retaining the bearing member within the handgrip with the bearing member rotationally in contact with an edge of the opening; and a support structure sized to be inserted through the top end opening of the handgrip so that when inserted into the handgrip, an end of the support member prevents the ball-shaped bearing member from moving to the handgrip top end.

21. The adjustable jump rope apparatus according to claim 20, wherein the end of the support structure that retains the ball-shaped bearing member bears a retaining cage.

* * * * *